US005746288A

United States Patent [19]

O'Neal et al.

[11] Patent Number: 5,746,288

[45] Date of Patent: May 5, 1998

[54] WALK BOARD

[76] Inventors: Diana O'Neal; Donald P. O'Neal, both of 2144 N. Hyder Mountain Rd., Cookeville, Tenn. 38506

[21] Appl. No.: 705,053

[22] Filed: Aug. 29, 1996

[51] Int. Cl.[6] ..... E04G 1/00

[52] U.S. Cl. ..... 182/118; 182/222; 182/129; 182/130

[58] Field of Search ..... 182/222, 223, 182/130, 129, 118; 108/64

[56] References Cited

U.S. PATENT DOCUMENTS

| | | | |
|---|---|---|---|
| Re. 30,020 | 6/1979 | Spencer et al. . | |
| 1,520,518 | 12/1924 | Thomason | 108/64 |
| 2,557,413 | 6/1951 | Crichton | 108/64 |
| 2,596,663 | 5/1952 | Duffy | 182/222 X |
| 2,783,107 | 2/1957 | Gacht | 108/64 |
| 2,851,311 | 9/1958 | Gibbs | 182/130 X |
| 2,954,093 | 9/1960 | Fitzgerald | 182/129 |
| 3,091,487 | 5/1963 | Gallagher | 108/64 |
| 3,128,842 | 4/1964 | Satrum . | |
| 3,463,265 | 8/1969 | Clover . | |
| 3,804,198 | 4/1974 | Palumbo . | |
| 4,031,981 | 6/1977 | Spencer . | |
| 4,675,929 | 6/1987 | Santo | 108/64 X |
| 4,951,780 | 8/1990 | Kim . | |
| 5,029,671 | 7/1991 | Larson . | |
| 5,218,914 | 6/1993 | Dickinson | 108/64 |
| 5,368,126 | 11/1994 | Woodward et al. . | |

*Primary Examiner*—Alvin C. Chin-Shue
*Attorney, Agent, or Firm*—Chase & Yakimo

[57] ABSTRACT

A walk board system comprises at least first and second platform assemblies, each assembly having first and second pairs of support legs pivotally connected to the platform. At least one of said pairs of legs presents a staircase for user entry onto the platform. The legs are selectably extensible to vary the height of the platform above the underlying ground surface. The legs are pivotable to a position within the confines of the platform so as to allow for easy transport of the platform assembly between work sites. About the perimeter of each platform are a plurality of slots designed to engage a depending flange of a fastener member therein. Upon placement of the platforms in a side-by-side relationship and alignment of selected slots therebetween, insertion of a fastener within the aligned slots will maintain the platforms in selectable adjacent relationships. The plurality of slots about the perimeter of each platform allows for the platforms to be placed in various adjacent relationships inclusive of straight line, corner or offset relationships. A tool holder on each platform allows for deposit of tools or other articles therein.

9 Claims, 10 Drawing Sheets

WALK BOARD

BACKGROUND OF THE INVENTION

This invention relates to a walk board and, more particularly, to a portable walk board system which presents a work platform having user selectable walk board configurations positioned at a user-selectable height.

Various forms of work platforms are known in the art, one type of platform being shown in U.S. Pat. No. 3,463,265, issued to Clover, and the other accompanying references cited in this application.

Although assumably effective in operation, it is particularly desirable to have a walk board which can easily be positioned in various configurations so that the walking surface can extend around corners, wall projections or indentations, pillars and other obstacles. Such a system can be used by painters, wallpaperers, plasterers, sheetrockers and other craftspersons who need to perform their job duties at an elevated position relative to the underlying support surface. Accordingly, it is desirable to have a walk board system which is portable and can easily present walking paths of various configurations.

In response thereto I have invented a walk board system which utilizes a plurality of releasably connectable platform assemblies, each platform assembly having a generally planar platform proper elevated above a support surface. About the perimeter of each platform are a plurality of slots adapted to releasably engage a portion of a clip fastener therein. Upon alignment of the slots between adjacent platforms, engagement of a clip within the slots will maintain the adjacent platform assemblies in an adjacent relationship so as to present a generally continuous platform/walking surface. The plurality of slots about the perimeter of the platform enables the user to position platform assemblies, at various relatively adjacent configurations, so as to present a walking path for the worker about various obstacles, such as corners, pillars or the like. The legs of each platform assembly are selectably extensible allowing the platform height to be varied. The assembly is preferably made of a lightweight material allowing for easy transport upon folding the support legs within the confines of the platform housing.

It is therefore a general object of this invention to provide a walk board system which presents various walking configurations.

Another object of this invention is to provide a system, as aforesaid, comprising a plurality of platform assemblies, each assembly having a platform supported by first and second pairs of extensible and foldable legs.

Another object of this invention is to provide a system, as aforesaid, including a plurality of slots positioned about the perimeter of each platform, the slots presenting apertures for engagement of fasteners therein.

Another object of this invention is to provide a system, as aforesaid, the fasteners securing adjacent platform assemblies in a user-selectable relationship so as to present a planar walking surface.

A more particular object of this invention is to provide a system, as aforesaid, wherein a pair of said legs of a platform assembly presents a stair case to allow the user to easily access the platform proper.

Another particular object of this invention is to provide a system, as aforesaid, the pairs of legs of each assembly being selectably extensible so as to present the platform walking surface at user-selectable heights relative to the underlying support surface.

A further object of this invention is to provide a system, as aforesaid, wherein the support legs are foldable within the confines of the platform allowing for easy transport.

Still a further object of this invention is to provide a system, as aforesaid, presenting a tool holder releasably attached to the platform proper.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
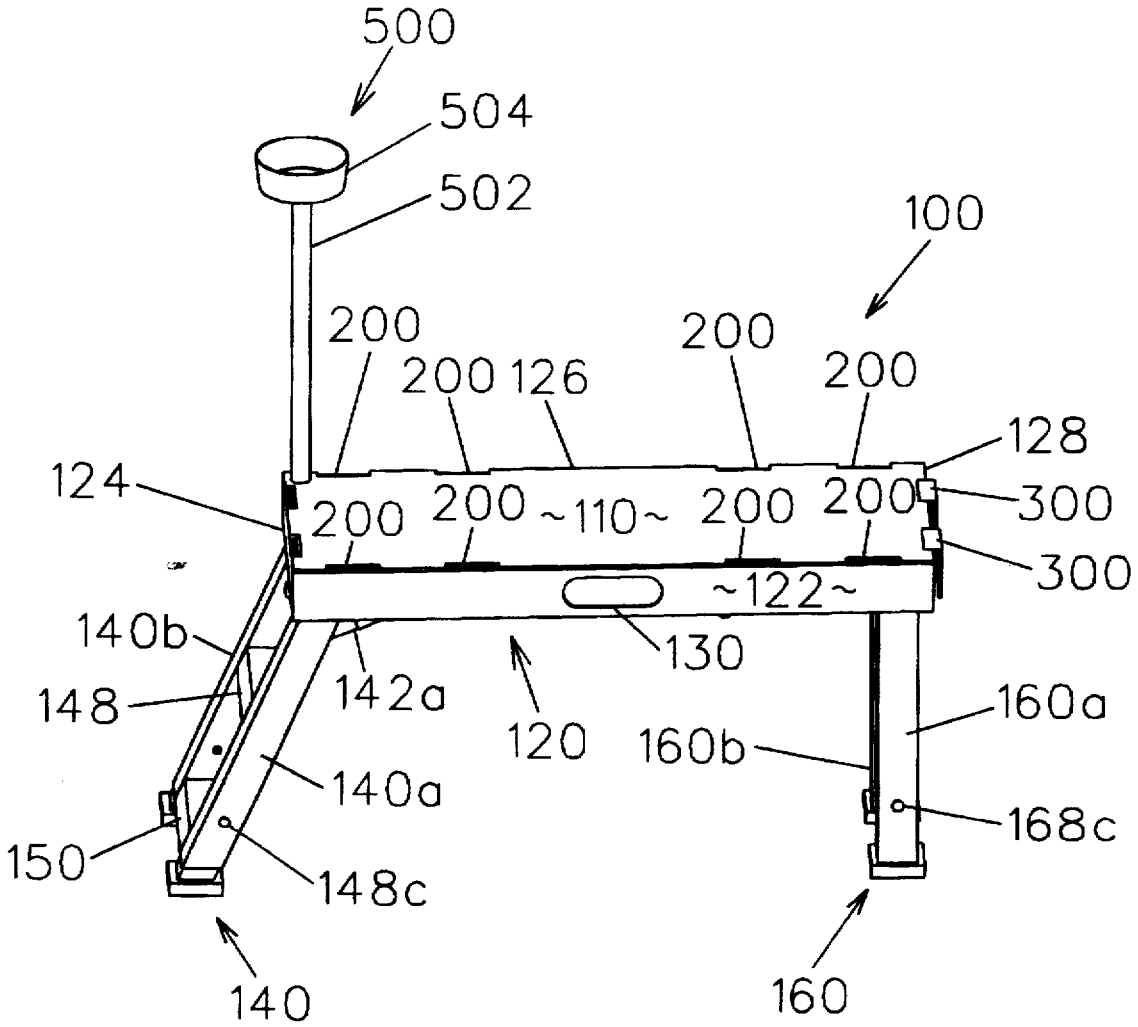
FIG. 1 illustrates a front perspective view of one platform assembly of the walk board system.
Figure 2:
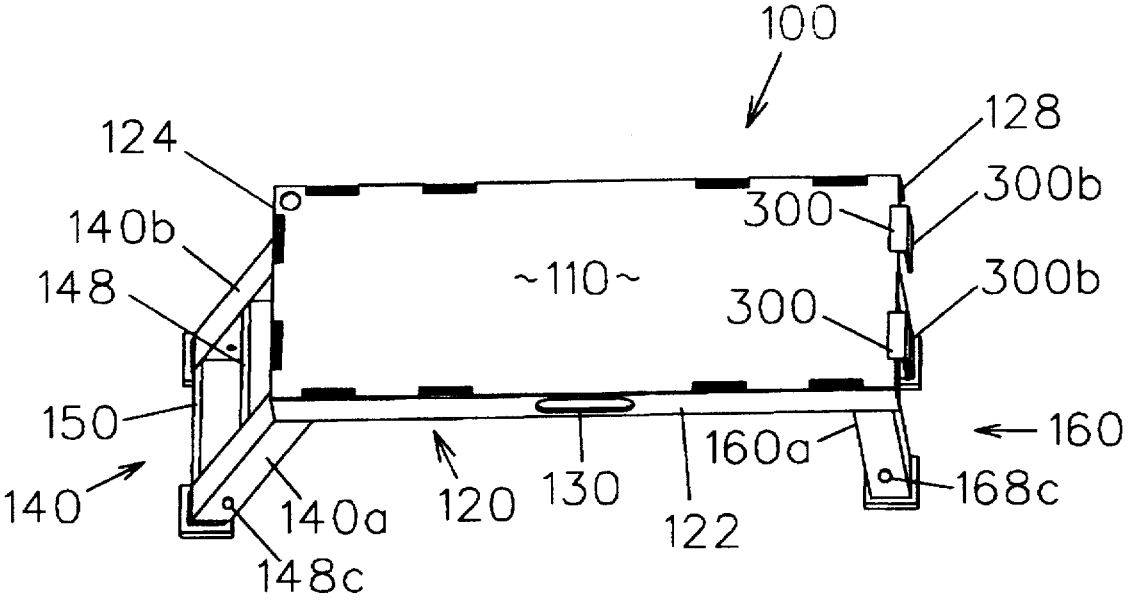
FIG. 2 is a top perspective view of the platform assembly of FIG. 1 on an enlarged scale.

Turning more particularly to the drawings, FIG. 1 shows one platform assembly 100 as comprising a platform proper 110 mounted atop base 120. Base 120 comprises a pair of laterally spaced-apart longitudinal walls 122, 126 and laterally spaced-apart end walls 124, 128. An aperture 130 in each sidewall 122, 126 provides a grip for transport of the assembly 100.

Figure 5:
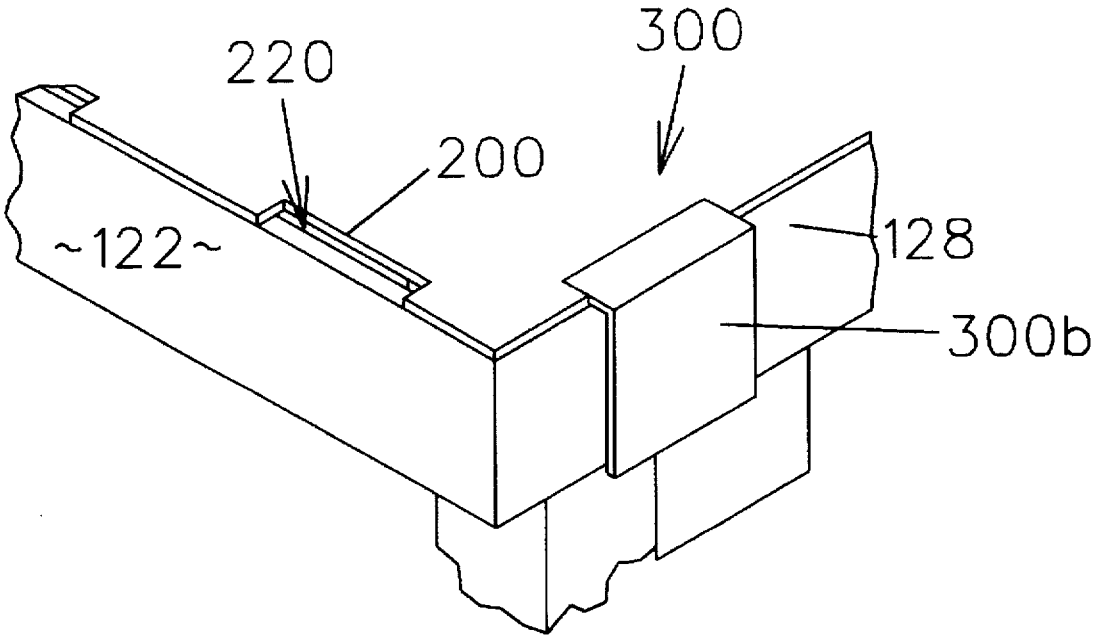
FIG. 5 is a fragmentary view of one corner of the platform on an enlarged scale and showing one leg of one clip fastener engaged within a slot.

Each assembly 100 further comprises a pair of support leg assemblies 140, 160 pivotally mounted at the ends of platform 110. As shown in FIG. 5, the support leg assembly 140 presents an angled staircase whereas support leg assembly 160 vertically underlies the platform 110. It is understood that in our system that support legs 140 need not be present in each platform assembly 100 but may be replaced with the vertical support leg assembly 160 as shown.

Figure 3:
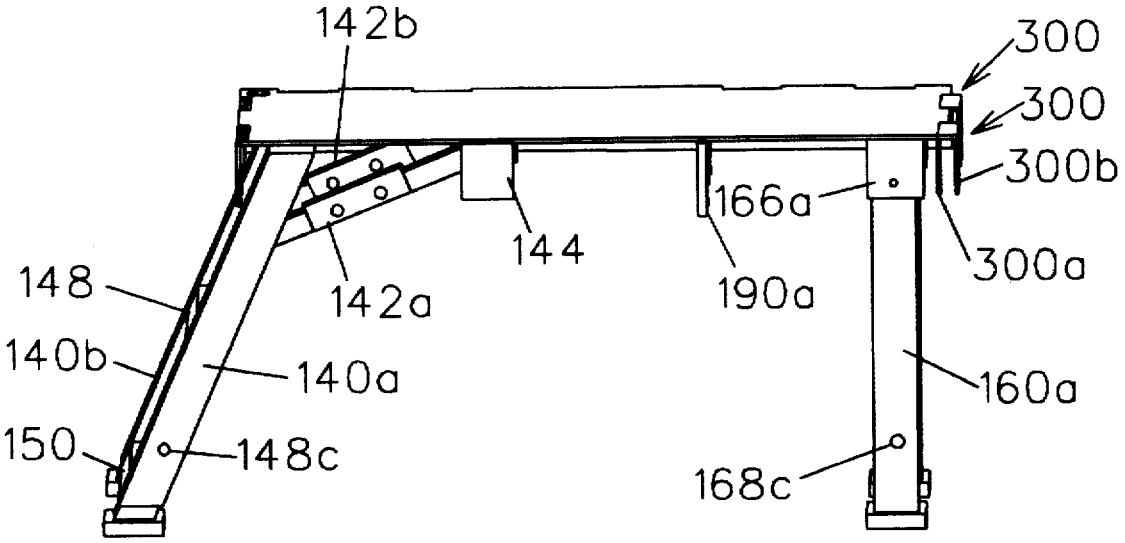
FIG. 3 is a front perspective view of the walk board assembly of FIG. 1 with a side wall of the platform removed so as to show the leg hinge structure therebelow.
Figure 4:
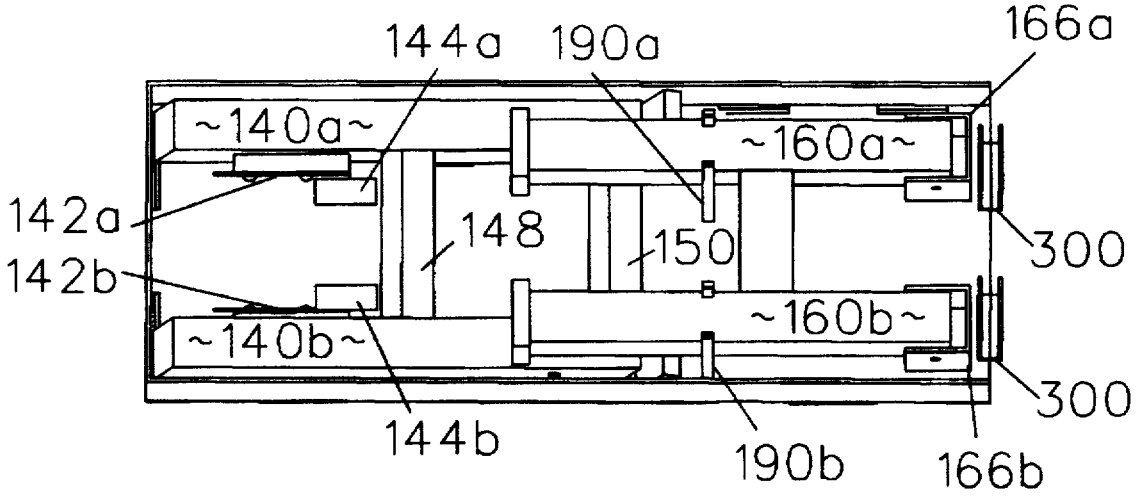
FIG. 4 is a bottom view of the platform assembly of FIG. 1 with the legs being folded into a storage position.

As shown in FIG. 3, the legs 140*a*, 140*b* of assembly 140 are pivotally connected to the platform by means of braces 142*a*, 142*b* extending between each respective leg 140*a*, 140*b* and depending flanges 144*a*, 144*b* and pivotally attached thereto. Braces 142*a*, 142*b* are further collapsible so as to allow the legs 140 to move between a support position as shown in FIG. 3 and a collapsed/folded storage position as shown in FIG. 4. As shown, the legs 140 extend at an angle relative to the platform 110 and have rungs 148, 150 extending therebetween so as to present a staircase to the user.

Legs 160*a*, 160*b* of assembly 160 are pivotally attached to depending brackets 166*a*, 166*b* so as to be rotatable between the FIG. 3 vertical position and the FIG. 4 storage position. As shown in FIG. 4, clips 190*a*, 190*b* depend from the underside of platform 110 and engage each leg 160*a*, 160*b* so as to retain the legs 160*a*, 160*b* and adjacent legs 140*a*, 140*b* in their collapsed storage position within the confines of the platform 110 base 120 allowing for easy transport by the user.

Figure 8:
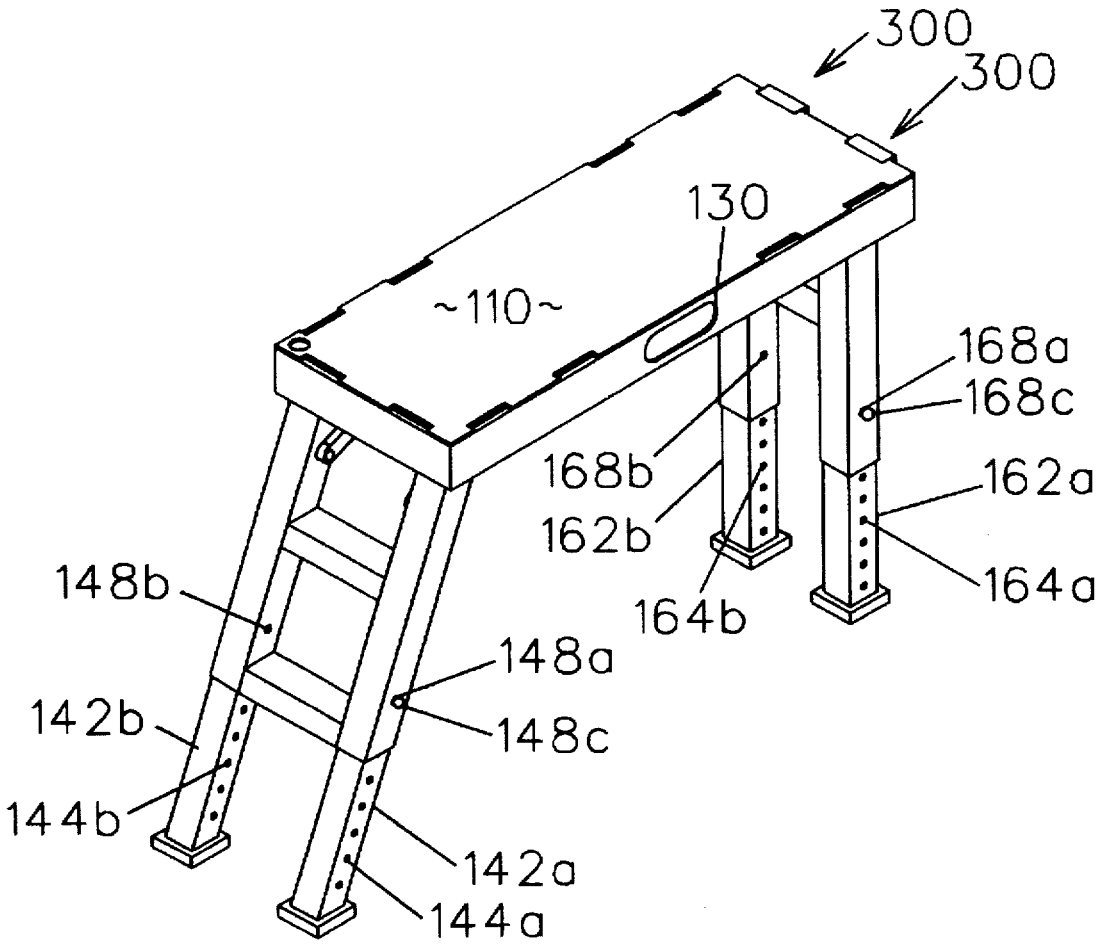
FIG. 8 is a perspective end view of the walk board assembly of FIG. 1 with the legs thereof being in an extended position.
Figure 9:
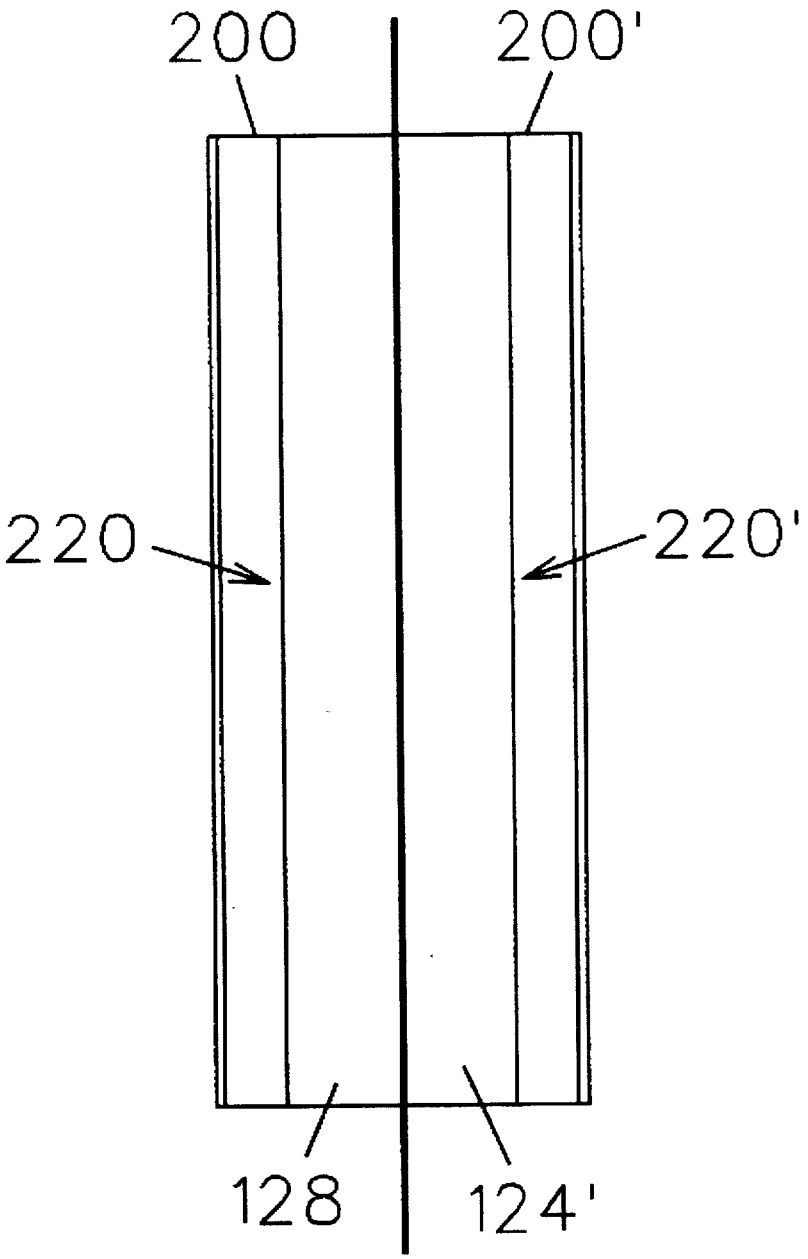
FIG. 9 is a fragmentary top view of a pair of slots of the system, on an enlarged scale.

As shown in FIG. 8, each leg 140*a*, 140*b*, 160*a*, 160*b* further includes an inner leg 142*a*, 142*b*, 162*a*, 162*b* slidable therein. Each inner leg has a plurality of apertures 144*a*, 144*b*, 164*a*, 164*b* therealong. Extension of each inner leg relative to the outer leg aligns an aperture along each inner leg with an aperture 148*a*, 148*b*, 168*a*, 168*b* in each outer leg which allows for extension of a pin member 148*c*, therethrough. Thus, the length of each leg assembly 140, 160 may be adjusted and maintained so as to vary the height of the overlying platform 110.

Also located on each platform is a tool holder 500 presenting a shaft 502 with housing 504, the housing 504 allow the user to place tools, nails and other articles therein.

Figure 7:
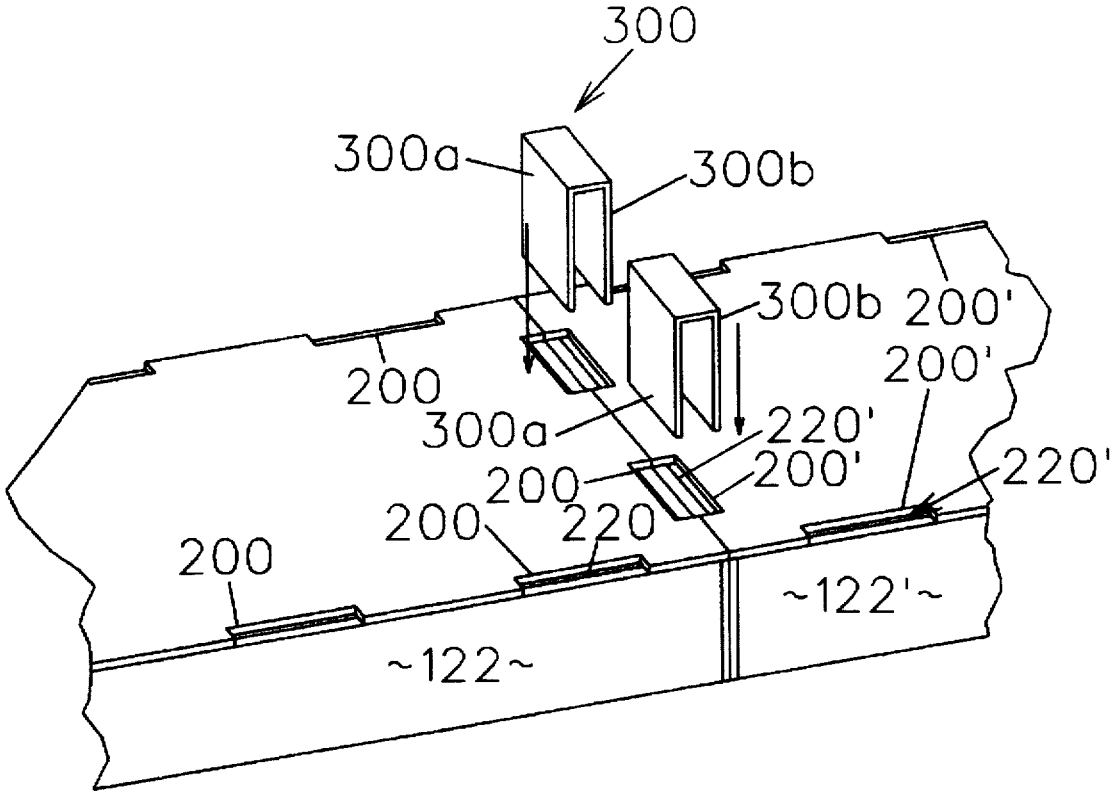
FIG. 7 is a perspective view, on an enlarged scale, showing the juncture of the platform assemblies of FIG. 6 with the clip fasteners exploded therefrom.

Extending about the perimeter of platform 110 are a plurality of apertures 200. Each aperture cooperates with the adjacent sidewall 122, 126 or end wall 124, 128 of base 120 so as to present a slot 220 therebetween. Slot 220 releasably engages one leg 300*a*, 300*b* depending from a web of a clip fastener 300 therein as shown in FIG. 7.

Figure 6:
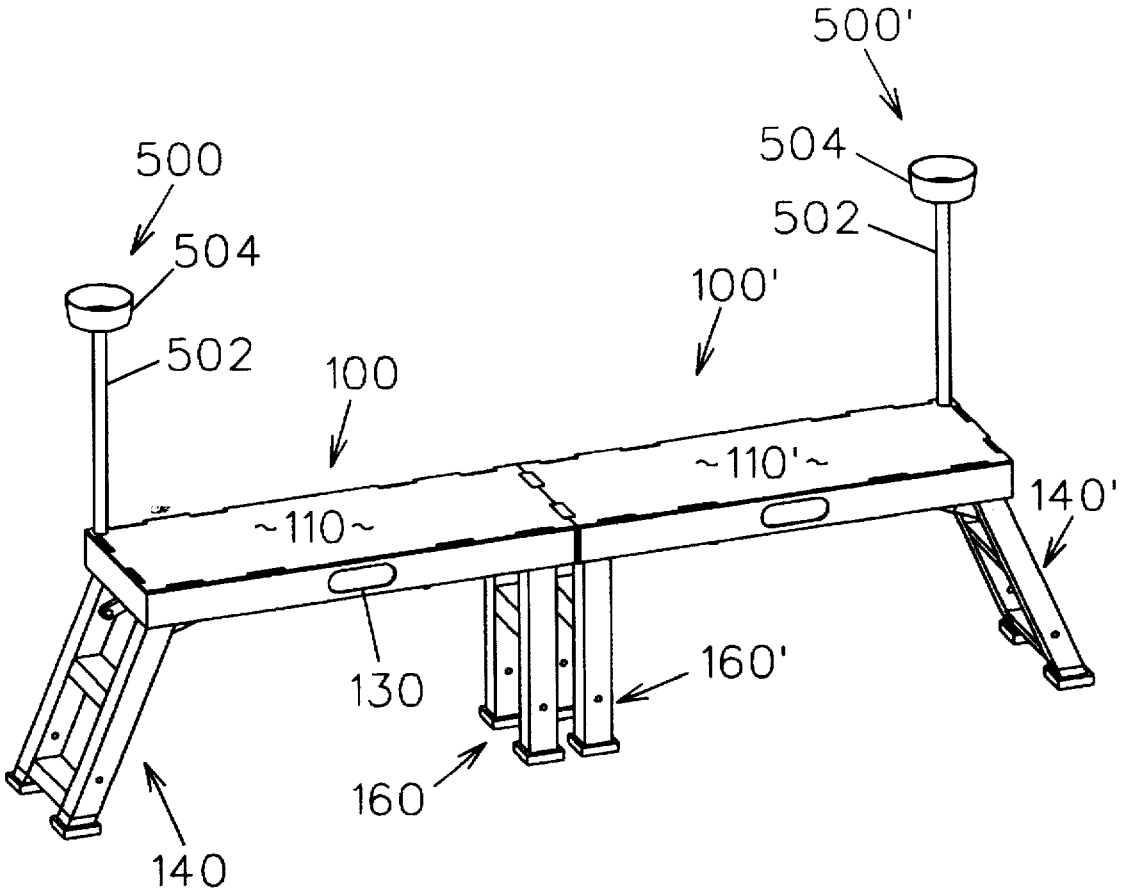
FIG. 6 is a perspective view showing a pair of platform assemblies connected in a longitudinal relationship.

Upon placement of two platform assemblies 100, 100' in a side-by-side relationship, as shown in FIGS. 6 and 8, the apertures 200, 200' and slots 220, 220' of each assembly are also in a side-by-side relationship. Each leg 300*a*, 300*b* of clip fastener 300 engages a slot 220, 220' so as to fasten the platform assemblies 100, 100' in a side-by-side relationship. This connection thus horizontally aligns the adjacent platforms 110, 110' so as to present a continuous walkway, the height of the walkway being adjustable by the action of the extensible leg pairs 140, 160 as above described.

Figure 10:
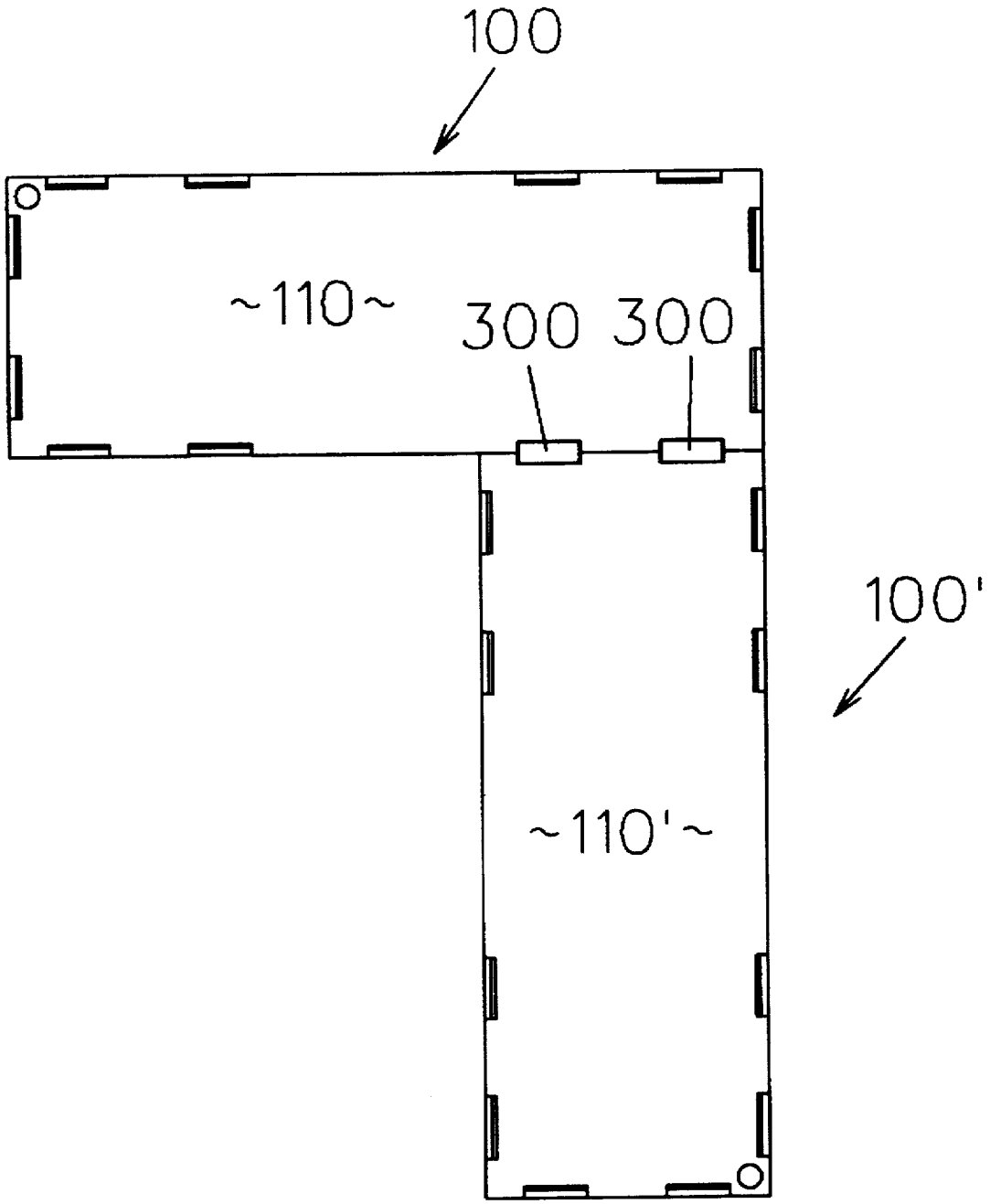
FIG. 10 is a top view showing first and second platform assemblies connected in a normal relationship to form a right angle walkway.

It is also understood that the relationship between the assemblies 100, 100' can be at various positions, one such position being the normal or right angle position as shown in FIG. 10. Upon placement of the clip fasteners 300 in the adjacent slots 220, 220', a right angle walkway is presented for working around corners or the like. It is also understood that only one slot 220 of one assembly 100 need be aligned with an adjacent slot 220' of another assembly 100' so as to offset the platforms 110, 110' therebetween. Accordingly, various walkway configurations can be presented according to the desires of the user.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A portable platform system comprising:

at least first and second platform assemblies with each assembly comprising:

a platform comprising a generally rectangular surface, said surface presenting first and second opposed end walls and first and second opposed sidewalls extending between said end walls;

support means connected to said platform for elevating said platform above an underlying surface;

first and second pairs of spaced-apart sidewall apertures in said surface and adjacent each sidewall, said sidewall apertures adjacent said first sidewall aligned with said sidewall apertures adjacent said second sidewall;

a pair of spaced-apart end wall apertures in said surface and adjacent each end wall, said end wall apertures adjacent said first end wall aligned with said end wall apertures adjacent said second end wall, said spaced-apart relationship between said end wall apertures generally equal to said spaced-apart relationship between said apertures of said pairs of said sidewall apertures, whereupon in a first mode a pair of said end wall apertures of said first platform assembly are adapted to be aligned either with a pair of said end wall apertures of said second platform assembly or adapted to be aligned in a second mode with one of said pairs of said sidewall apertures of said second platform assembly;

fastener means comprising a web with a pair of depending legs, one of said legs adapted for user selectable insertion within an aperture of one of said end wall apertures of said first platform assembly with the other said leg adapted for user selectable insertion within one of said apertures of either said aligned end wall apertures in said first mode or said aligned sidewall apertures in said second mode of said adjacent second platform assembly, whereupon said web in said first mode spans adjacent end walls of adjacent first and second platform assemblies to connect said platforms in a longitudinally adjacent relationship or in a second mode spans an adjacent end wall and sidewall of adjacent first and second platform assemblies to connect said platform assemblies in a generally normal relationship for maintaining a walkway therebetween, wherein said web of said fastener means is generally coplanar with said surfaces of adjacent platform assemblies.

2. The system as claimed in claim 1 wherein said support means comprises first and second pairs of support legs pivotally connected at said opposed end walls of each platform, each pair of legs pivotal between a first position normal to said platform and a second position generally parallel to said platform.

3. The system as claimed in claim 2 wherein one of said pair of support legs further comprises at least one rung extending between a leg of said pair of legs whereby to present a staircase to said platform in said first position.

4. The system as claimed in claim 2 further comprising:

a base circumscribing a perimeter of said platform and depending therefrom, said first and second pairs of support legs within the confines of said base at said second position;

means for maintaining said pairs of support legs at said second position.

5. The system as claimed in claim 2 wherein each support leg of said pair of support legs comprises:

an outer leg;

an inner leg slidably extensible relative to said outer leg;

means for maintaining a selected relationship between said inner and outer leg whereby to vary a length of each of said support legs.

6. The system as claimed in claim 1 further comprising a tool holder connected to said platform, said tool holder comprising:

a shaft;

a container at an upper end of said shaft for holding articles therein.

7. The system as claimed in claim 1 wherein one of said apertures of one of said pair of end wall apertures of a first platform assembly is adapted to be aligned in a third mode with one of said apertures of a pair of end wall apertures of said platform of an adjacent second platform assembly in a manner to offset said platform surfaces of said first and second platform assemblies therebetween, said fastener means legs adapted for user selectable insertion in said respective aligned end wall apertures in said third mode to connect said platform assemblies in said offset relationship.

8. The system as claimed in claim 1 wherein one of said apertures of said end wall apertures of said first platform assembly is adapted to be aligned in a fourth mode with one of said apertures of said sidewall aperture in said second platform assembly in a manner to offset said platform surfaces of said first and second platform assemblies therebetween, said fastener means legs adaptable for user selectable insertion in said respective aligned apertures in said fourth mode to connect said platform assemblies in said offset relationship.

9. The system as claimed in claim 1 wherein one of said apertures of one of said pair of side wall apertures of a first platform assembly is adapted to be aligned in a fifth mode with one of said apertures of a pair of side wall apertures of said platform of an adjacent second platform assembly in a manner to offset said platform surfaces of said first and second platform assemblies therebetween, said fastener means legs adapted for user selectable insertion in said respective aligned sidewall apertures in said fifth mode to connect said platform assemblies in said offset relationship.

* * * * *

UNITED STATES PATENT AND TRADEMARK OFFICE

CERTIFICATE OF CORRECTION

PATENT NO. : 5,746,288

DATED : May 5, 1998

INVENTOR(S) : Diana O'Neal and Donald P. O'Neal

It is certified that error appears in the above-identified patent and that said Letters Patent is hereby corrected as shown below:

Column 3, line 19, after "148c" insert --168c--.

Signed and Sealed this

Seventh Day of July, 1998

Bruce Lehman

*Attest:*

BRUCE LEHMAN

*Attesting Officer*

*Commissioner of Patents and Trademarks*